US011174769B2

(12) United States Patent
Hirozawa et al.

(10) Patent No.: US 11,174,769 B2
(45) Date of Patent: Nov. 16, 2021

(54) WORK MACHINE PROVIDED WITH ENGINE

(71) Applicant: KOBELCO CONSTRUCTION MACHINERY CO., LTD., Hiroshima (JP)

(72) Inventors: Mitsunori Hirozawa, Hiroshima (JP); Masayuki Kagoshima, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/970,496

(22) PCT Filed: Jan. 16, 2019

(86) PCT No.: PCT/JP2019/001130
§ 371 (c)(1),
(2) Date: Aug. 17, 2020

(87) PCT Pub. No.: WO2019/181160
PCT Pub. Date: Sep. 26, 2019

(65) Prior Publication Data

US 2020/0378284 A1 Dec. 3, 2020

(30) Foreign Application Priority Data

Mar. 23, 2018 (JP) ..... JP2018-056791

(51) Int. Cl.
*F01N 13/08* (2010.01)
*F01N 3/021* (2006.01)
(Continued)

(52) U.S. Cl.
CPC ..... *F01N 3/021* (2013.01); *F01N 9/00* (2013.01); *F01N 13/08* (2013.01); *F02B 63/06* (2013.01);
(Continued)

(58) Field of Classification Search
CPC . F01N 3/021; F01N 9/00; F01N 13/08; F01N 2900/04; F01N 2900/08;
(Continued)

(56) References Cited

U.S. PATENT DOCUMENTS

2008/0282682 A1* 11/2008 C. ..... G01N 15/0656 60/277
2010/0031733 A1* 2/2010 Bollinger ..... F02D 41/1466 73/28.04
(Continued)

FOREIGN PATENT DOCUMENTS

EP 2 350 443 A1 8/2011
JP 2010-223158 A 10/2010
(Continued)

OTHER PUBLICATIONS

International Search Report dated Apr. 23, 2019 in PCT/JP2019/001130 filed on Jan. 16, 2019, 1 page.
(Continued)

*Primary Examiner* — Matthew T Largi
(74) *Attorney, Agent, or Firm* — Oblon, McClelland, Maier & Neustadt, L.L.P.

(57) ABSTRACT

A work machine is capable of detecting an abnormality in the amount of soot in exhaust gas in an exhaust pipe upstream of an exhaust gas aftertreatment device. The work machine includes: an exhaust gas sensor which detects the amount of soot contained in exhaust gas between an engine and an exhaust gas aftertreatment device and generates a soot amount detection signal; and a controller into which the detection signal is input. The controller includes an abnormality judgment section that makes an abnormality judgment on whether or not the detected soot amount is abnormal, and a threshold setting section that sets a soot amount threshold that is a threshold for making the abnormality judgment. The abnormality judgment section judges an
(Continued)

abnormality when the value of the soot amount corresponding to the soot amount detection signal is larger than the soot amount threshold.

8 Claims, 5 Drawing Sheets

(51) Int. Cl.
*F01N 9/00* (2006.01)
*F02B 63/06* (2006.01)
*F02D 41/02* (2006.01)
*E02F 9/22* (2006.01)

(52) U.S. Cl.
CPC ..... *F02D 41/0235* (2013.01); *E02F 9/2235* (2013.01); *F01N 2900/04* (2013.01); *F01N 2900/08* (2013.01); *F01N 2900/1402* (2013.01)

(58) Field of Classification Search
CPC ..... F01N 2900/1402; F01N 2900/10; F01N 2590/08; F01N 2900/00; F01N 2560/05; F02D 41/0235; E02F 9/2235; F02B 63/06
See application file for complete search history.

(56) References Cited

U.S. PATENT DOCUMENTS

2010/0101409 A1* 4/2010 Bromberg ..... F01N 13/009 95/8
2010/0180669 A1* 7/2010 Baars ..... F01N 11/00 73/28.04
2011/0000199 A1 1/2011 Ezawa et al.
2011/0047978 A1 3/2011 Zawacki et al.
2011/0047985 A1 3/2011 Zawacki et al.
2011/0048106 A1 3/2011 Zawacki et al.
2012/0011829 A1* 1/2012 Taibi ..... F01N 3/103 60/274
2012/0053814 A1* 3/2012 George ..... F01N 3/0231 701/102
2012/0174564 A1 7/2012 Zawacki et al.
2012/0186330 A1* 7/2012 Ueno ..... G01N 15/0656 73/23.33
2012/0260636 A1* 10/2012 Hashida ..... F01N 11/00 60/276
2013/0014641 A1* 1/2013 Takaoka ..... F01N 9/002 95/26
2013/0019653 A1 1/2013 Nakata
2013/0192214 A1* 8/2013 Yanakiev ..... F01N 11/00 60/295
2013/0255353 A1 10/2013 Zawacki et al.
2013/0298534 A1 11/2013 Yahata et al.
2019/0032588 A1* 1/2019 Yamamoto ..... F02D 41/1494

FOREIGN PATENT DOCUMENTS

JP 2013-24097 A 2/2013
JP 2013-234642 A 11/2013
JP 2017-96215 A 6/2017

OTHER PUBLICATIONS

Extended European Search Report dated Oct. 8, 2020 in European Patent Application No. 19771428.0, 7 pages.

* cited by examiner

WORK MACHINE PROVIDED WITH ENGINE

TECHNICAL FIELD

The present invention relates to a work machine provided with an engine, the work machine being capable of detecting an abnormality in exhaust gas from the engine.

As a work machine provided with an engine, there is known one further provided with an exhaust gas aftertreatment device for processing exhaust gas discharged from the engine. The exhaust gas aftertreatment device is provided in an exhaust pipe connected to an engine and collects soot from the exhaust gas, such as the exhaust gas aftertreatment device described in FIG. 6 of Patent Document 1.

However, the exhaust gas aftertreatment device as described above may hinder an abnormality from being found out in the amount of soot in the exhaust gas of the engine due to a failure of the engine, that is, the larger amount of soot than a predetermined amount. Specifically, a work machine without the exhaust gas aftertreatment device lets soot in the exhaust gas to be directly discharged to the atmosphere as black smoke or white smoke, thus allowing an abnormal amount of the soot to be visually detected. However, a work machine provided with the exhaust gas aftertreatment device, which collects soot to block it from being discharged, may render an abnormality in the amount of soot and eventually an engine failure that is the cause thereof difficult to find out.

Patent Document 1, although disclosing provision of an exhaust gas sensor in an exhaust pipe upstream of the exhaust gas aftertreatment device to judge presence/absence of a failure in an exhaust gas sensor that detects the amount of soot (FIG. 6 and paragraph 0025 in the document), indicates no disclosure about a technique for detecting an abnormality in the amount of soot on the upstream side of the exhaust gas aftertreatment device.

CITATION LIST

Patent Literature

Patent Literature 1: Japanese Unexamined Patent Publication No. 2013-234642

SUMMARY OF INVENTION

It is an object of the present invention to provide a work machine provided with an engine, the work machine being capable of appropriately judging an abnormality in the amount of soot in an exhaust pipe located upstream of an exhaust gas aftertreatment device.

Provided is a work machine including an engine, an exhaust pipe, an exhaust gas aftertreatment device, an exhaust gas sensor, and a controller. The engine is a power source of the work machine. The exhaust pipe is connected to the engine so as to allow exhaust gas of the engine to pass through the exhaust pipe. The exhaust gas aftertreatment device collects soot contained in the exhaust gas discharged from the engine through the exhaust pipe. The exhaust gas sensor is attached to the exhaust pipe so as to detect the amount of soot of exhaust gas in the exhaust pipe at a position between the engine and the exhaust gas aftertreatment device, and generates a soot amount detection signal corresponding to the amount of soot. The controller is connected to the exhaust gas sensor so as to allow the detection signal to be input from the exhaust gas sensor to the controller. The controller includes an abnormality judgment section that makes an abnormality judgment that is a judgment whether or not the amount of soot corresponding to the soot amount detection signal is abnormal, and a threshold value setting section that sets a soot amount threshold value that is a threshold value for making the abnormality judgment. The abnormality judgment section is configured to judge that the amount of soot of the exhaust gas is abnormal to output an abnormality judgment signal when the soot amount detection value that is the value of the amount of soot corresponding to the soot amount detection signal input from the exhaust gas sensor is larger than the soot amount threshold value.

DESCRIPTION OF EMBODIMENTS

An embodiment of the present invention will be described with reference to FIG. 1 to FIG. 5.

Figure 1:
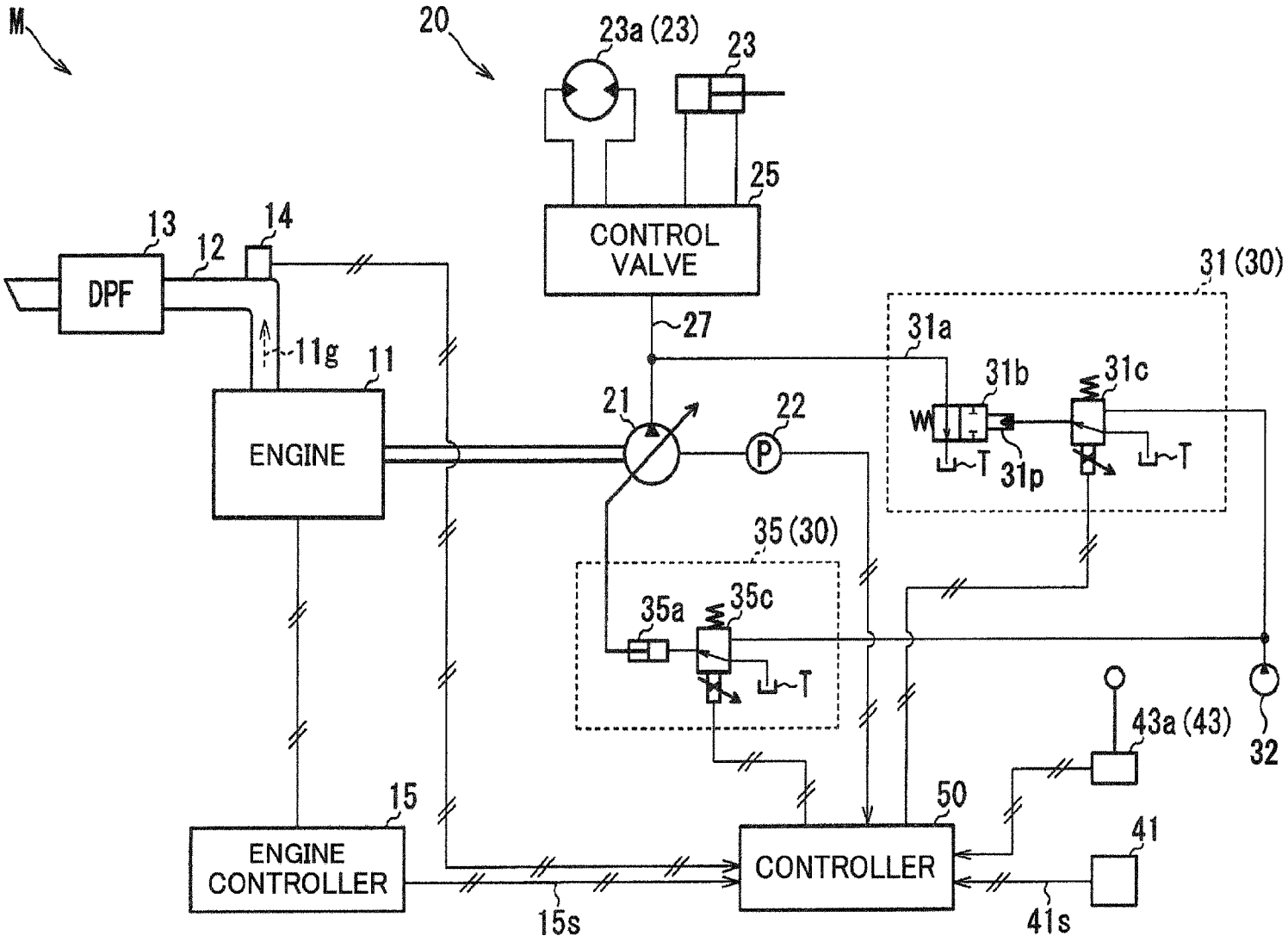
FIG. 1 is a circuit diagram showing a main part of a work machine according to an embodiment of the invention.

FIG. 1 is a circuit diagram showing a main part of a work machine M according to the embodiment. The work machine M is a machine that performs work, for example, a construction machine that performs construction work, for example, an excavator. The work machine M includes an engine 11, an exhaust pipe 12, an exhaust gas aftertreatment device 13, an exhaust gas sensor 14, an engine controller 15, a hydraulic circuit 20, a judgment command signal input unit 41, a plurality of operation units 43, and a controller 50.

The engine 11 is a power source of the work machine M, for example, a diesel engine. The exhaust pipe 12 is connected to the engine 11 so as to allow an exhaust gas 11*g*, which is a gas emitted by the engine 11, to flow through the exhaust pipe 12. The exhaust gas aftertreatment device 13 is a device for collecting soot contained in the exhaust gas 11*g*, for example, a DPF (Diesel particulate filter) device. The exhaust gas aftertreatment device 13 is provided in the middle of the exhaust pipe 12.

The exhaust gas sensor 14 is a sensor that detects the amount of soot contained in the exhaust gas 11*g*, namely, a soot sensor, and generates a soot amount detection signal that is an electrical signal corresponding to the amount of soot. The exhaust gas sensor 14 is, for example, a PM (Particulate Matter) sensor. The exhaust gas sensor 14 is mounted to the exhaust pipe 12 in a region between the engine 11 and the exhaust gas aftertreatment device 13 so as to detect the amount of soot in the exhaust gas 11*g* flowing through the flow path of the exhaust pipe 12 in the region. The expression "a region between the engine 11 and the exhaust gas aftertreatment device 13" includes the outlet of the engine 11 and the inlet of the exhaust gas aftertreatment device 13, namely, the opposite ends of the region.

The engine controller 15 is a device that controls the operation of the engine 11, for example, an ECU (Engine control unit). The engine controller 15 receives an input of a predetermined signal (data) and outputs a predetermined signal. The engine controller 15 outputs an engine detection signal 15*s* including information about a physical quantity (parameter) that specifies the operating state of the engine 11.

The hydraulic circuit 20 is operated by the engine 11 as a power source to thereby hydraulically actuate the work machine M. The hydraulic circuit 20 includes a hydraulic pump 21, a pump pressure sensor 22, a plurality of hydraulic actuators 23, a control valve unit 25, and a load application section 30.

The hydraulic pump 21 is driven by the power generated by the engine 11 to thereby suck and discharge the hydraulic oil in the tank T. The hydraulic pump 21 according to this embodiment has a variable capacity. The pump pressure sensor 22 detects a pump pressure which is a discharge pressure of the hydraulic pump 21. Specifically, the pump pressure sensor 22 generates a pump pressure detection signal which is an electric signal corresponding to the pump pressure. The pump pressure detection signal is used for specifying the load applied to the hydraulic pump 21.

The plurality of hydraulic actuators 23 are arranged to actuate a plurality of parts of the work machine M, respectively. Each of the plurality of hydraulic actuators 23 is driven by the supply of hydraulic oil from the hydraulic pump 21. The plurality of hydraulic actuators 23 include a plurality of hydraulic motors and a plurality of hydraulic cylinders. The plurality of hydraulic cylinders are arranged so as to actuate, for example, attachments of the work machine M, namely, a boom, an arm, a bucket, and the like, which are not graphically shown, respectively. The plurality of hydraulic motors include a slewing motor that slews a not-graphically-shown upper slewing body relatively to a not-graphically-shown lower travelling body, and a travel motor 23*a* that causes the lower travelling body to travel.

The control valve unit 25 includes a plurality of control valves for controlling respective operations of the plurality of hydraulic actuators 23. The plurality of control valves are provided in a plurality of oil passages between the hydraulic pump 21 and the plurality of hydraulic actuators 23, respectively. Each of the plurality of control valves is opened so as to control the direction and the flow rate of hydraulic oil supplied from the hydraulic pump 21 to the hydraulic actuator 23 corresponding to the control valve among the plurality of hydraulic actuators 23.

The load applying section 30 performs a load applying operation of applying a load to the engine 11 by applying a load to the hydraulic pump 21. The load application unit 30 applies a load greater than the load of the hydraulic pump 21 in an idling state described later to the hydraulic pump 21. The load application section 30 is able to apply a load to the hydraulic pump 21 without operating any of the plurality of hydraulic actuators 23. Specifically, the load application unit 30 according to this embodiment includes an unload circuit 31 and a pump capacity changing unit 35.

The unload circuit 31 is a circuit for returning the hydraulic fluid discharged from the hydraulic pump 21 to the tank T when none of the hydraulic actuators 23 is operated. The unload circuit 31 includes an unload oil passage 31*a*, an unload valve 31*b*, and an unload-valve operating proportional solenoid valve 31*c*. The unloading oil passage 31*a* is an oil passage that brings a pump oil passage 27 that interconnects the hydraulic pump 21 and the control valve unit 25 into communication with the tank T. The unload valve 31*b* is provided in the middle of the unload oil passage 31*a*. The unload valve 31*b* has a pilot port 31*p* and is opened at an opening degree corresponding to the pilot pressure that is input to the pilot port 31*p*. The unloading-valve operating proportional solenoid valve 31*c* is operated so as to change the opening degree of the unloading valve 31*b*. Specifically, the unloading-valve operating proportional solenoid valve 31*c* is provided in the middle of a pilot line connecting the pilot port 31*p* of the unloading valve 31*b* and the pilot pump 32 as a pilot hydraulic pressure source, and opened to change the pilot pressure that is input to the unload valve 31*b* according to an on-load command signal which is an electric signal input to the unload-valve operating proportional solenoid valve 31*c*, that is, to change the opening degree of the unload valve 31*b*.

The pump capacity changing unit 35 performs a capacity operation of changing the capacity of the hydraulic pump 21. The pump capacity changing unit 35 changes the capacity of the hydraulic pump 21 by changing the tilt angle of the hydraulic pump 21. The pump capacity changing unit 35 includes a capacity operating cylinder 35*a* and a cylinder operating proportional solenoid valve 35*c*. The capacity operation cylinder 35*a* is, for example, a hydraulic cylinder, being connected to the hydraulic pump 21 so as to change the tilt angle of the hydraulic pump 21 by expansion and contraction thereof. The cylinder operating proportional solenoid valve 35*c* performs a valve opening operation so as to expand and contract the capacity operating cylinder 35*a*. Specifically, the cylinder operating proportional solenoid valve 35*c* is interposed between the pilot pump 32 and the capacity operation cylinder 35*a*, and opened at the opening degree corresponding to a capacity command signal which is an electric signal input to the cylinder operating proportional solenoid valve 35*c*, thereby changing the flow rate of the hydraulic oil supplied from the pilot pump 35 to the capacity operation cylinder 35*a*.

The judgment command signal input unit 41 is configured to input a judgment command signal 41*s* for instructing execution of abnormality judgment to the controller 50. The judgment command signal input unit 41 is, for example, a button or a switch that inputs the judgment command signal 41*s* in response to an operation applied thereto by an operator or the like on the work machine M. However, the judgment command signal input unit 41 is not limited to one to which an operation is applied by the operator. The judgment command signal output unit 41 may be configured, for example, to automatically input the judgment command signal 41*s* to the controller 50 when a judgment start condition that is preset with respect to the state of the work machine M is satisfied.

An operation is applied to each of the plurality of operation units 43 by an operator to operate the plurality of hydraulic actuators 23. Each of the plurality of operation units 43 includes, for example, an operation lever to which an operation for moving the hydraulic actuator 23 corresponding to the operation unit 43 is applied. The plurality of operation units 43 and the judgment command signal input unit 41 may be disposed either inside the cab of the work machine M or outside the work machine M for remote control of the work machine M. Each of the plurality of operation units 43 generates an operation signal which is an electric signal having a magnitude corresponding to the operation amount which is the magnitude of the operation applied thereto, and inputs the operation signal to the controller 50. The plurality of operation units 43 include an attachment operation unit to which an attachment operation for moving the attachment is applied, and a slewing operation unit to which a slewing operation for slewing the upper slewing body relatively to the lower travelling body. The plurality of operation units 43 further include a travelling operation unit 43*a* to which a travelling operation for travelling the lower travelling body is applied. The travelling operation unit 43*a* generates a travelling operation signal which is an operation signal having a magnitude corresponding to a travelling operation amount which is the operation amount of the travelling operation unit 43*a*.

The controller 50 performs arithmetic control operation including the abnormality judgment. The controller 50 is, for example, an excavator controller that controls the operation of the work machine M. To the controller 50, the detection signals are input. To the controller 50, the soot amount detection signal generated by the exhaust gas sensor 14 is input. To the controller 50, respective operation signals generated by the plurality of operation units 43 are input, the operation signals including the travelling operation signal generated by the travelling operation unit 43*a*. The controller 50 controls the operation of the control valve unit 25 so as to cause the hydraulic actuator 23 corresponding to the operation signal operates to make a motion according to the input operation signal. To the controller 50, the engine detection signal 15*s* generated by the engine controller 15 is input, the engine detection signal 15*s* including information about an engine rotational speed corresponding to the rotational speed of the engine 11. The controller 50 stores a soot amount detection value which is a detection value for the amount of soot specified by the soot amount detection signal.

Next will be described, with reference mainly to FIG. 2, the arithmetic control operation performed by the controller 50 and the action of the work machine M associated therewith.

As a function for performing the arithmetic control operation, the controller 50 includes an abnormality judgment section that judges whether or not the value of the amount of soot of the exhaust gas detected by the exhaust gas sensor 14 is abnormal, a threshold value setting section that sets a soot amount threshold value that is a threshold value for making the abnormality judgment, and a load application control section that performs the load application control. The outline of the arithmetic control operation performed by them is as follows.

The abnormality judgment section of the controller 50 makes the abnormality judgment on the necessary condition that one of the preset first engine load stabilizing condition and the preset second engine load stabilizing condition is satisfied. (step S21 and step S61 of FIG. 2, respectively). The abnormality judgment is a judgment on whether or not the amount of soot in the exhaust gas 11*g* flowing from the engine 11 to the exhaust gas aftertreatment device 13 in the exhaust pipe 12 is abnormal. Specifically, the abnormality judgment is a judgment on whether or not the soot amount detection value, which is the value of the amount of soot detected by the exhaust gas sensor 14, is abnormal. The abnormality judgment therefore enables an engine failure diagnosis, which is a diagnosis on whether or not the engine 11 is out of order, to be done. On the other hand, the abnormality judgment section of the controller 50 suspends the abnormality judgment when neither of the first and second engine load stabilization conditions is satisfied.

The change in the load applied to the engine 11 may largely change the amount of soot and thereby disable the controller 50 from appropriately making the abnormality judgment, which is why it is the necessary condition for making the abnormality judgment that at least one of the first and second engine load stabilization conditions is satisfied. Each of the first and second engine load stabilization conditions is a condition for stabilizing the load applied to the engine 11, that is, a condition for stabilizing the amount of soot, in other words, a condition for allowing the abnormality judgment to be properly made. Therefore, the abnormality judgment section of the controller 50 makes the abnormality judgment in steps S21 and S61 on the necessary condition that one of the first and second engine load stabilization conditions is satisfied. In other words, the abnormality judgment section of the controller 50 suspends the abnormality judgment when neither of the first and second engine load stabilization conditions is satisfied. As described below, the expression "suspending abnormality judgment" encompasses both of a mode of suspending an abnormality judgment process itself and a mode of performing an abnormality judgment process while making the soot amount threshold value for abnormality judgment be great enough to substantially prevent the judgment of abnormality. Alternatively, it may be done to set only one engine load stabilizing condition (for example, only one of the first and second engine load stabilizing conditions) and to make the abnormality judgment on the necessary condition that the one engine load stabilizing condition is satisfied.

The first engine load stabilizing condition is that no operation for moving the hydraulic actuator 23 is applied to any of the plurality of operating sections 43 (YES in step S13), and the load application control (step S15) is being performed. The condition for making the abnormality judgment in step S21 according to the present embodiment includes, in addition to the first engine load stabilization condition (necessary condition), that the judgment command signal 41*s* is input to the controller 50 (YES in step S11). Hereinafter will be described a specific example of the first judgment execution condition and the abnormality judgment (step S21) that is executed when the first judgment execution condition is satisfied.

Figure 2:
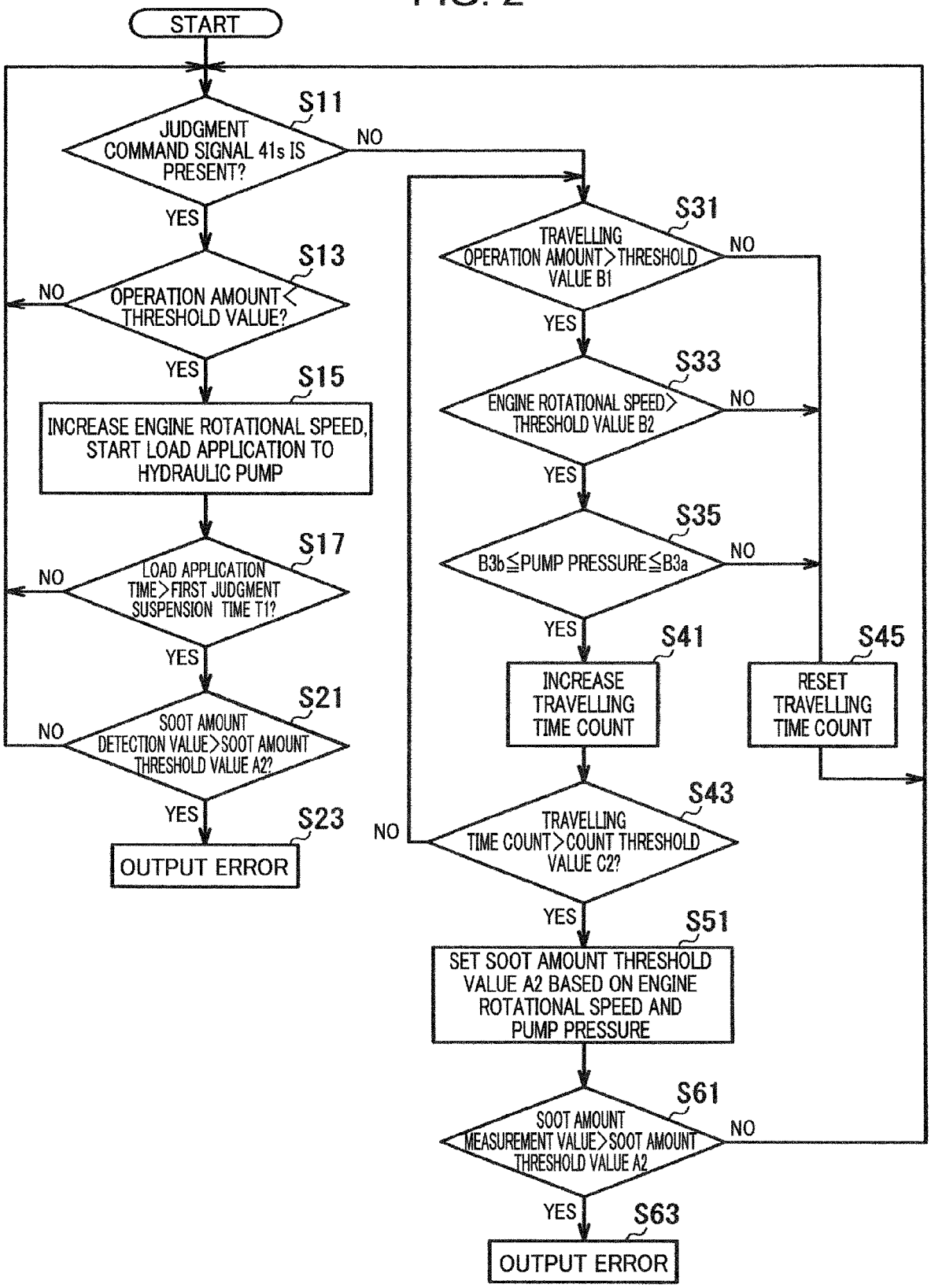
FIG. 2 is a flowchart which shows the arithmetic control operation performed by a controller of the work machine.

In step S11 of FIG. 2, the controller 50 judges whether or not the judgment command signal 41*s* is input to the controller 50. For example, the controller 50 judges whether it is selected through the judgment command signal input unit 41 (for example, by the operator) to make the abnormality judgment. When the judgment command signal 41*s* is input to the controller 50 (YES in step S11), the abnormality judgment section judges whether or not the first engine load stabilizing condition is satisfied (step S13, S17). When the judgment command signal 41*s* is not input to the controller 50 (NO in step S11), the abnormality judgment section judges whether or not the second engine load stabilizing condition is satisfied (step S31, S35).

In step S13, the abnormality judgment section of the controller 50 judges whether or not an operation for operating the hydraulic actuator 23 is applied to at least one of the plurality of operation units 43. Specifically, the abnormality judgment section of the controller 50 compares the operation amount specified by the operation signal output by each of the plurality of operation units 43 with the threshold value set for the operation amount. The operation amount can be specified, for example, based on the operation signal input from the operation unit 43 to the controller 50. The threshold value with respect to the operation amount and other threshold values are stored in the controller 50 in advance. These thresholds may be calculated by the controller 50 depending on the situation. When the operation amounts of the plurality of operation units 43 are all less than the threshold value (YES in step S13), the load application control section of the controller 50 executes step S15 described below. The case where respective operation amounts of the plurality of operation units 43 are all less than the threshold value is, for example, a case where neither of the attachment operation, the slewing operation, and the travelling operation is performed. When at least one of these operations is applied to the corresponding operation unit 43 (NO in step S13), the abnormality judgment section suspends the abnormality judgment in step S21 for the reason described below.

In step S15, the load application control section of the controller 50 performs the load application control. The load application control is the control of causing the load application section 30 to perform a load application operation of applying a load to the hydraulic pump 21. Under the load application control, the load application unit 30 applies a higher load to the hydraulic pump 21 than the load of the hydraulic pump 21 in the idling state. In the idling state, the engine 11 is operating but none of the plurality of hydraulic actuators 23 is operating, so that the hydraulic pump 21 is substantially unloaded, in other words, in other words, only the load due to loss such as pressure loss, mechanical loss and the like is applied thereto. In this idling state, no load application control is performed. In the load application control, the controller 50 may make the engine rotational speed corresponding to the rotational speed of the engine 11 higher than the engine rotational speed in the idling state. The load application control section of the controller 50 performs the load application control only when the load application condition is satisfied, the condition being that the judgment command signal 41*s* is input to the controller 50 (YES in step S11) and no operation for moving the hydraulic actuator 23 is applied to any of the plurality of operation units 43 (YES in step S13). When the load application condition is not satisfied (NO in step S11 or NO in step S13), the load application control section of the controller 50 stops the load application control. The load application condition does not have to include the requirement that the judgment command signal 41*s* be input to the controller 50 (YES in step S11).

The reason why the load application control is performed is as follows. In the idling state, the amount of soot is small because the load on the hydraulic pump 21 is small and the load on the engine 11 is small, as compared with, for example, a state in which one of the plurality of hydraulic actuators 23 is operating. This makes it difficult for the abnormality judgment section of the controller 50 to appropriately make the abnormality judgment. However, the amount of soot can be increased by the load application unit 30 applying a load to the hydraulic pump 21 and applying a load to the engine 11. For this reason, the load applied by the load application unit 30 to the hydraulic pump 21 is given such a magnitude that the amount of soot required for the controller 50 to appropriately make the abnormality judgment (step S21) is secured. Furthermore, the amount of soot can be secured by increasing the engine rotational speed of the engine 11. The engine rotational speed in this case is set to a rotational speed that allows a amount of soot required to appropriately make the abnormality judgment to be secured.

A specific example of load application to the hydraulic pump 21 by the load application control is as follows. The load application operation by the load application section 30 to the hydraulic pump 21 includes a load application by the unload circuit 31 and a load application by the pump capacity changing section 35.

The load application by the unload circuit 31 is performed as follows. The load application control section of the controller 50 inputs an electric signal, namely, an on-load command signal, to the unload-valve operating proportional solenoid valve 31*c*, thereby increasing the pilot pressure input to the pilot port 31*b* of the unload valve 31*b* through the unload-valve operating proportional solenoid valve 31*c*. The increase in the pilot pressure reduces the opening degree of the unload valve 31*b*, throttling the unload oil passage 31*a* to a degree corresponding to the pilot pressure as compared with that in the idling state. This increases the pump pressure, which is the discharge pressure of the hydraulic pump 21, thus increasing the load on the hydraulic pump 21.

The load application by the pump capacity changing unit 35 is performed as follows. The load application control section of the controller 50 inputs an electric signal, namely, a capacity command signal, to the cylinder operating proportional solenoid valve 35*c* to open the cylinder operating proportional solenoid valve 35*c* at an opening degree corresponding to the capacity command signal, thereby allowing hydraulic oil to be supplied from the pilot pump 32 to the capacity operation cylinder 35*a*. The capacity operation cylinder 35*a* is moved by the hydraulic oil applied thereto so as to increase the capacity of the hydraulic pump 21 beyond the capacity in the idling state, thereby increasing the output torque of the hydraulic pump 21 to increase the load on the hydraulic pump 21. As a result, the load on the engine 11 is increased. There may be performed either only one of the load application by the unload circuit 31 and the load application by the pump capacity changing unit 35 or both of them. Besides, the hydraulic pump 21 may be loaded by means other than them.

Figure 3:
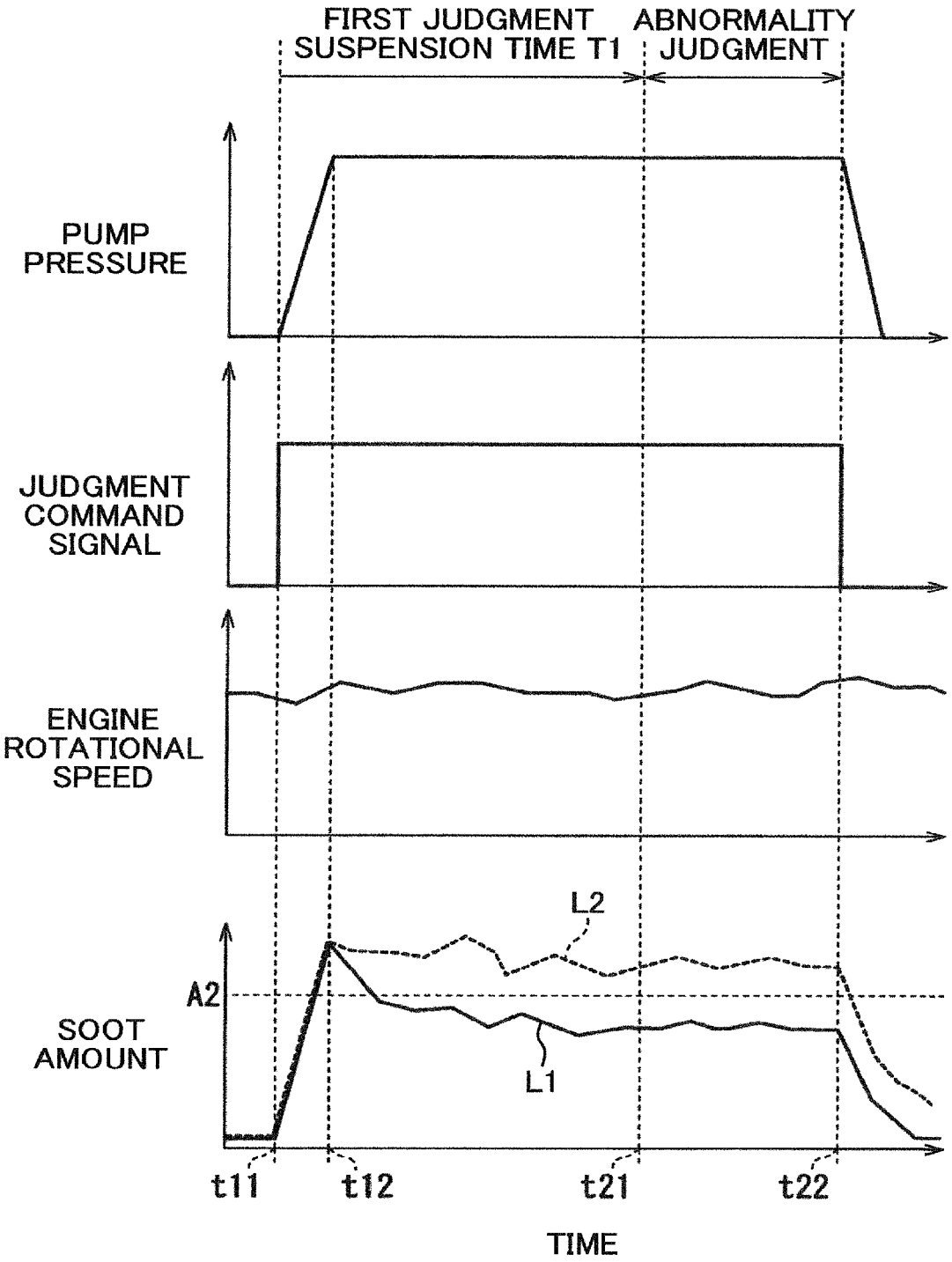
FIG. 3 is a timing chart showing an example of respective temporal changes in a plurality of physical quantities and judgment command signals that are detected in the work machine.

Following the start of the load application control, in step S17, the abnormality judgment section of the controller 50 judges whether or not the load application time, which is the time from the time point t11 when the load application control is started to the present time, as shown in FIG. 3, is longer than the preset first judgment suspension time T1, that is, whether or not the first judgment suspension time T1 has elapsed since the load application control was started. At the time point when the load application control is stopped, the abnormality judgment section resets the load application time to zero. The reason why this judgment is performed is as follows. Immediately after the start of the load application control, the load of the hydraulic pump 21 and the load of the engine 11 are not stable, and the amount of soot is therefore not stable, which may hinder the abnormality judgment from being appropriately made in step S21. For this reason, the controller 50 suspends the abnormality judgment until the predetermined time T1 elapses from the time point t11 when the load application control is started, and starts the abnormality judgment at the time point t21 when the predetermined time elapses (step S21). This enables the abnormality judgment section of the controller 50 to make the abnormality judgment only when the load of the hydraulic pump 21 (pump pressure in FIG. 3) is stable and the amount of soot is stable. In other words, it restrains erroneous abnormality judgment from being performed when the amount of soot is unstable. The predetermined time T1 is therefore set to the time required for stabilizing the amount of soot after the start of the load application control. The measurement starting time point when the measurement of the first judgment suspension time T1 is started is not limited to the start time point t11 of the load application control. The measurement start time point may be, for example, the time point when the detected pump pressure, which is the pump pressure detected by the pump pressure sensor 22, namely, the discharge pressure of the hydraulic pump 21, rises to reach a predetermined pressure (for example, the time point t12 shown in FIG. 3). The "predetermined pressure" is, for example, stored in the controller 50 in advance.

After the elapse of the first judgment suspension time T1 (YES in step S17), the abnormality judgment section of the controller 50 makes the abnormality judgment in step S21. Each of the abnormality judgment in step S21 and the abnormality judgment in step S61 described later is a judgment on whether or not the amount of soot of the exhaust gas 11*g* is abnormal. The abnormality judgment in step S21 is performed on the necessary condition that the load application control is being performed, thus being suspended when the load application control is not performed. The abnormality judgment is performed based on the soot amount detection value which is the value of the amount of soot detected by the exhaust gas sensor 14. The soot amount detection value used for the abnormality judgment may be either a value of the amount of soot detected by the exhaust gas sensor 14 at a certain moment or a either value of the total value, the average value and the like of the amount of soot detected by the exhaust gas sensor 14 within a predetermined period. The threshold value setting section of the controller 50 sets a soot amount threshold value A2 (see FIG. 3) which is a soot amount threshold value for making the abnormality judgment. The abnormality judgment section of the controller 50 compares the soot amount detection value with the soot amount threshold value A2. When the amount of soot measurement value is larger than the soot amount threshold value A2 (YES in step S21), the abnormality judgment section of the controller 50 judges that the amount of soot of the exhaust gas 11*g* is abnormal and outputs an abnormality judgment signal (Yes step S23). In this case, it can be assumed that the engine 11 is out of order. When the soot amount detection value is equal to or less than the soot amount threshold value A2 (NO in step S21), the controller 50 judges that the amount of soot is not abnormal (for example, normal) and outputs no abnormality judgment signal.

The abnormality judgment signal is a judgment signal indicating that the amount of soot is abnormal, namely, an error signal. The abnormality judgment signal can be used in various ways. For example, the abnormality judgment signal may be used to notify an operator that the amount of soot is abnormal, by being input to a notification device as a notification command signal for activating the notification device provided in the cab. The abnormality judgment may be, alternatively, input to the engine controller 15 or the hydraulic circuit 20 to restrict the operation of the work machine M. For example, it may be used to limit the operation of at least one of the engine 11 and the plurality of hydraulic actuators 23.

FIG. 3 is a timing chart showing an example of respective temporal changes in the physical quantity and the judgment command signal related to the first engine load stabilizing condition, wherein the lowermost solid line L1 shows an example of a normal amount of soot and the broken line L2 shows an example of an abnormal amount of soot. At the time point t11 when the judgment command signal 41*s* is input to the controller 50 (YES in step S11) in the state where no operation for operating the hydraulic actuator 23 is applied to any of the plurality of operation units 43 (YES in step S13), the load application control (step S15) is started. The load application control increases the discharge pressure of the hydraulic pump 21 to increase the amount of soot. From the time point t12 when the discharge pressure of the hydraulic pump 21 reaches a predetermined pressure, the discharge pressure and the amount of soot of the hydraulic pump 21 become stable. Then, at the time point t21 when the predetermined judgment suspension time T1 has elapsed from the time t11 when the load application control was started, the abnormality judgment (step S21) is started. Thereafter, at the time point when the judgment command signal 41*s* is turned off, that is, at the time point t22 when the input of the judgment command signal 41*s* to the controller 50 is stopped (NO in step S11), the load application control (step S15) is stopped, decreasing the discharge pressure of the pump 21 and the amount of soot. However, also the abnormality judgment (step S21) is stopped at the time point t22, thereby being prevented from being continued in the state of low amount of soot.

If the load application control is continued while an operation by an operator is applied to any one of the plurality of operation units 43 to move the corresponding the hydraulic actuator 23, the hydraulic actuator 23 may make a motion contrary to the operator's intention. However, in a state where an operation is applied to at least one of the plurality of operation units 43 for operating the corresponding hydraulic actuator 23 (NO in step S13), the load application control section of the controller 50 according to the present embodiment does not perform the load application control (step S15). Besides, at the time point when an operation is applied to any of the plurality of operation units 43 for moving the hydraulic actuator 23 corresponding thereto during the execution of the load application control (NO in step S13), the load control unit stops the load control. On the other hand, the controller 50 inputs a command signal to the control valve unit 25 so as to move the hydraulic actuator 23 in response to an operation applied to the operation unit 43. This restrains the hydraulic actuator 23 from making a motion contrary to the operator's intention due to the load application control.

When any one of the plurality of hydraulic actuators 23 is operated, for example, when the attachment is operated and/or when the upper stewing body is slewed relatively to the lower travelling body, respective loads of the hydraulic pump 21 and the engine 11 fluctuate to make the amount of soot be likely to fluctuate, which may hinder an appropriate abnormality judgment from being performed. However, the abnormality judgment section of the controller 50, which is configured to stop the abnormality judgment at the time point when an operation for moving the hydraulic actuator 23 corresponding to any one of the plurality of operation units 43 is applied (NO in S13), even during the execution of the abnormality judgment in step S21, is prevented from performing an inappropriate abnormality judgment.

The first engine load stabilizing condition can be set even in the case where the "at least one hydraulic actuator" connected to the hydraulic pump 21 is only a single hydraulic actuator (for example, only the travelling motor 23*a*) and the "at least one operation unit" corresponding to the hydraulic actuator is only a single operation unit (for example, only the travelling operation unit 43*a*).

The second engine load stabilizing condition in this embodiment is that the travelling operation amount, which is the magnitude of the travelling operation applied to the travelling operation unit 43*a*, is greater than the travelling operation amount threshold B1 which is a preset threshold value (YES in step S31), and the pump pressure, which is the discharge pressure of the hydraulic pump 21, is within the preset load stable range B3 (YES in step S35). The reason why the second engine load stabilizing condition is thus determined is as follows.

The abnormality judgment in step S21 is executed on the condition that the first engine load stabilizing condition is satisfied and that the judgment command signal 41*s* is input from the judgment command signal input unit 41 to the controller 50. Therefore, in the case where the judgment command signal input unit 41 is configured to input the judgment command signal 41*s* in response to an operation applied to the judgment command signal input unit 41 by an operator, the abnormality judgment in step 21 is not made without an operation applied to the judgment command signal input unit 41 by the operator. However, when the load of the hydraulic pump 21 is stable to allow the load of the engine 11 to be judged to be stable, it is preferable that an abnormality judgment is made even without an input of the judgment command signal 41*s*.

The second engine load stabilization condition is a condition set from that point of view. Specifically, in the travelling state in which the work machine M is travelling, the load of the hydraulic pump 21 is more likely to be stable than in the state in which the attachment operation or the slewing operation is performed while the travelling is stopped. Furthermore, in the travelling state, where the load of the hydraulic pump 21 and the load of the engine 11 are higher than that in the idling state, it is easy to secure a sufficient amount of soot. That is why it is included in the second engine load stabilizing condition, as the necessary condition for making the abnormality judgment in step S61 in addition to step S21, that the work machine M is in the travelling state.

Besides, even when the work machine M is in the travelling state, the load of the hydraulic pump 21 and the engine 11 may be unstable, depending on the state of the ground on which the work machine M is travelling. For example, the load of the hydraulic pump 21 and the engine 11 in a state where the work machine M is travelling on a slope or a rough road (swamp or the like) is less likely to be stabilized than that when the work machine M is continuously travelling on a flat ground. For this reason, the second engine load stabilizing condition also includes the requirement for the pump pressure. Hereinafter will be described a specific example of the second engine load stabilization condition and the abnormality judgment (step S61) executed when the condition is satisfied.

When the judgment command signal 41*s* is not input (NO in step S11), the abnormality judgment section of the controller 50 judges, in step S31, whether or not a travelling operation for travelling the work machine M is applied to the travelling operation unit 43*a*. Specifically, the abnormality judgment section of the controller 50 compares the travel operation amount, which is the magnitude of the travel operation applied to the travel operation unit 43*a*, with the travel operation amount threshold B1 that is preset for the travel operation amount. The travel operation amount can be specified, for example, based on the travel operation signal that is input to the controller 50 from the travel operation unit 43*a*. When the travelling operation amount is larger than the travelling operation amount threshold value B1, that is, when the travelling operation for causing the work machine M to substantially travel is applied to the travelling operation unit 43*a* (YES in step S31), the next requirement regarding the engine rotational speed is judged (step S33). When the travelling operation amount is equal to or less than the travelling operation amount threshold B1, that is, when no travelling operation for causing the work machine M to substantially travel is applied to the travelling operation unit 43*a* (NO in step S31), the abnormality judgment section resets the travelling time count, which is a count for measuring the travelling time (step S45).

In step S33, the abnormality judgment section of the controller 50 compares the engine rotational speed of the engine 11 with an engine rotational speed threshold value B2 preset for the engine rotational speed. The information about the engine rotational speed can be input to the controller 50, for example, from the engine controller 15 or a rotational speed sensor provided separately from the engine controller 15. When the engine rotational speed is higher than the engine rotational speed threshold B2 (YES in step S33), the abnormality judgment section judges whether or not the next requirement for the pump pressure is satisfied (step S35). When the engine rotational speed is equal to or lower than the engine rotational speed threshold value B2 (NO in step S35), the abnormality judgment section resets the travelling time count (step S45).

Figure 5:
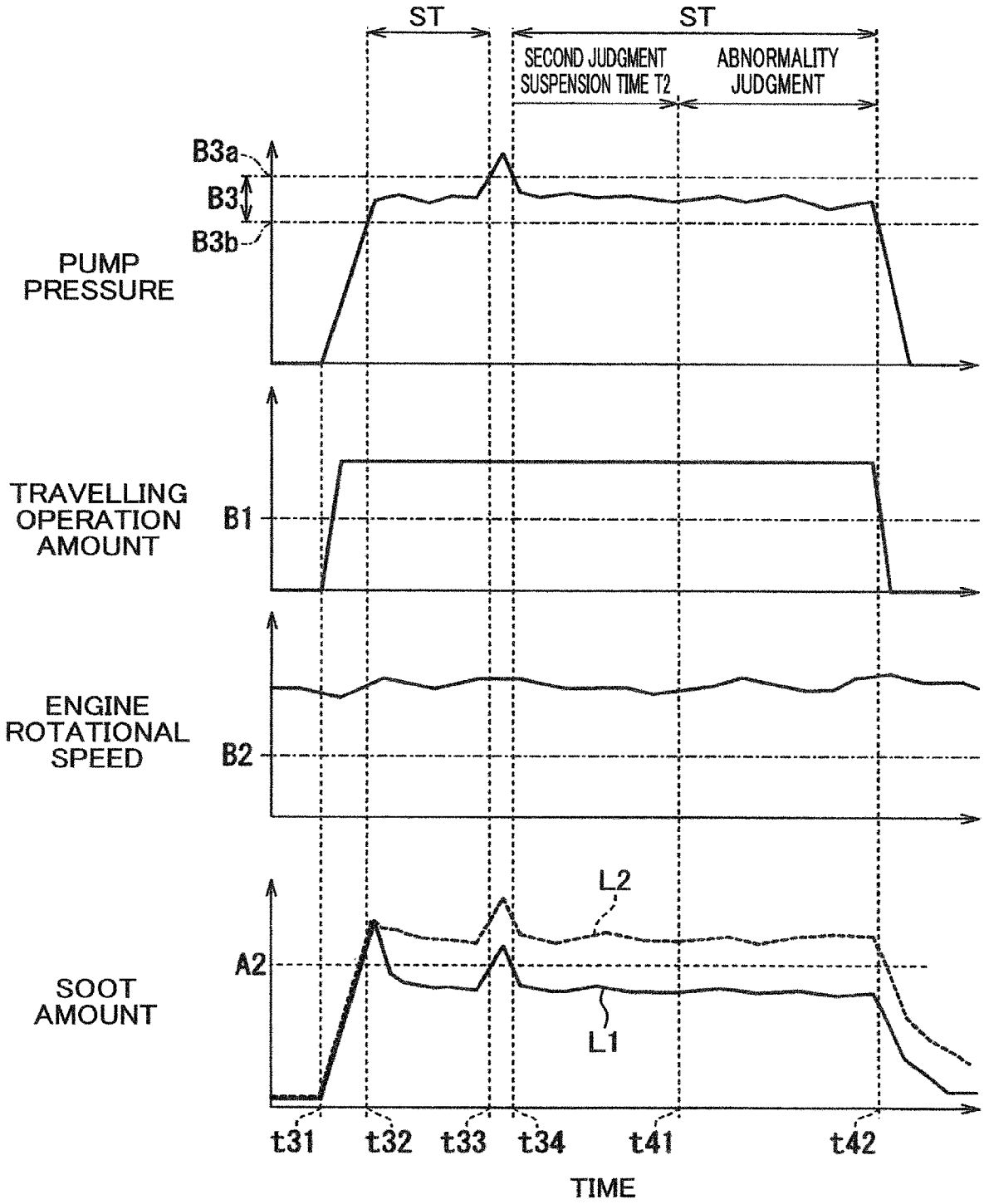
FIG. 5 is a timing chart which shows an example of respective temporal changes in a plurality of physical quantities and travel operation amount that are detected in the work machine.

In step S35, the abnormality judgment section of the controller 50 judges whether or not the load of the hydraulic pump 21 is within a predetermined range. Specifically, the controller 50 judges whether or not the detected pump pressure is within the preset load stable range B3 as shown in FIG. 5. The detected pump pressure can be specified based on the pump pressure detection signal input from the pump pressure sensor 22 to the controller 50. The load stable range B3 shown in FIG. 5 is a range between the lower limit B3*b* and the upper limit B3*a* that are set for the pump pressure from the viewpoint of load stability. The load stable range B3 is set so as to include the value of the pump pressure when the work machine M is travelling on a level ground. On the contrary, the load stable range B3 is set so as to exclude from the stable load range B3 a value of the pump pressure that can be detected when the work machine M is travelling on a slope or a rough road, the value being so excessively large or so excessively small value of the pump pressure that it cannot be detected when the work machine M is travelling on a flat ground. When the detected pump pressure is out of the load stable range B3 (NO in step S35), that is, when the detected pump pressure is less than the lower limit value B3*b* or greater than the upper limit value B3*a*, the abnormality judgment section resets the travelling time count (step S45). When the detected pump pressure is within the load stable range B3 (YES in step S35), that is, when the detected pump pressure is equal to or higher than the lower limit value B3*b* and equal to or lower than the upper limit value B3*a*, the abnormality judgment section increases the time count (step S41).

Hereinafter, the state where the travelling operation amount is larger than the travelling operation amount threshold value B1 (YES in step S31) and the pump pressure is within the load stable range B3 (YES in step S35) is referred to as "stable travelling state ST". The requirement for corresponding to the stable travelling state ST may further include that the engine rotational speed is higher than the engine rotational speed threshold B2. If the stable travelling state ST continues, the load on the hydraulic pump 21 is stabilized and the amount of soot is also stabilized. On the other hand, the time during which the stable travelling state ST continues is short, the load on the hydraulic pump 21 and the amount of soot are unstable, which may disable the abnormality judgment section of the controller 50 from making an appropriate abnormality judgment. For this reason, the abnormality judgment section of the controller 50 measures the duration of the stable travelling state $\alpha$ (hereinafter, also referred to as "stable travelling time") as shown in FIG. 5, and starts the abnormality judgment in step S61 at the time point t41 until which the state ST continues for the preset second judgment suspension time T2 (that is, at the time point when the stable travelling time reaches the second judgment suspension time T2) (FIG. 5). This allows the abnormality judgment section of the controller 50 to make the abnormality judgment only when the load of the hydraulic pump 21 is stable and the amount of soot is stable. The second judgment suspension time T2 is, therefore, set based on the duration of the stable travelling state ST required for stabilizing the load of the hydraulic pump 21 and the amount of soot. A specific example of the measurement of the continuation time, namely, the stable travelling time, is as follows.

As described above, in step S41, the abnormality judgment section of the controller 50 increases the "travelling time count" for measuring the stable travelling time.

In step S43, the abnormality judgment section compares the stable travel time with the second judgment suspension time T2 that is a threshold value set in advance for the stable travel time. Specifically, the abnormality judgment section of the controller 50 according to this embodiment compares the travelling time count with a count threshold C2 corresponding to the second judgment suspension time T2. At the time point when the travelling time count reaches the count threshold value, that is, at the time point t41 when the stable travelling time reaches the second judgment suspension time T2 (YES in step S43), the setting section of the controller 50 sets a soot amount threshold value for abnormality judgment (step S51), and, based thereon, the abnormality judgment section makes the abnormality judgment (step S61). Until the travelling time count reaches the count threshold value C2, that is, until the stable travelling time reaches the second judgment suspension time T2 (NO in step S43), setting the soot amount threshold value and the abnormality judgment based thereon is not executed, while the abnormality judgment section repeatedly increases the travelling time count (step S41).

If the stable travelling state ST disappears before the stable travelling time reaches the second judgment suspension time T2 (NO in any of steps S31, S33, S35), the abnormality judgment section resets the travelling time count, that is, returns it to the initial value (step S45).

In step S51, the threshold setting section of the controller 50 calculates the soot amount threshold A2. The reason for calculating the soot amount threshold value A2 is as follows. The amount of soot varies depending on the operating state (load, etc.) of the engine 11. Hence, setting the soot amount threshold value A2 according to the operating state of the engine 11 enables an appropriate abnormality judgment of the amount of soot to be made.

Figure 4:
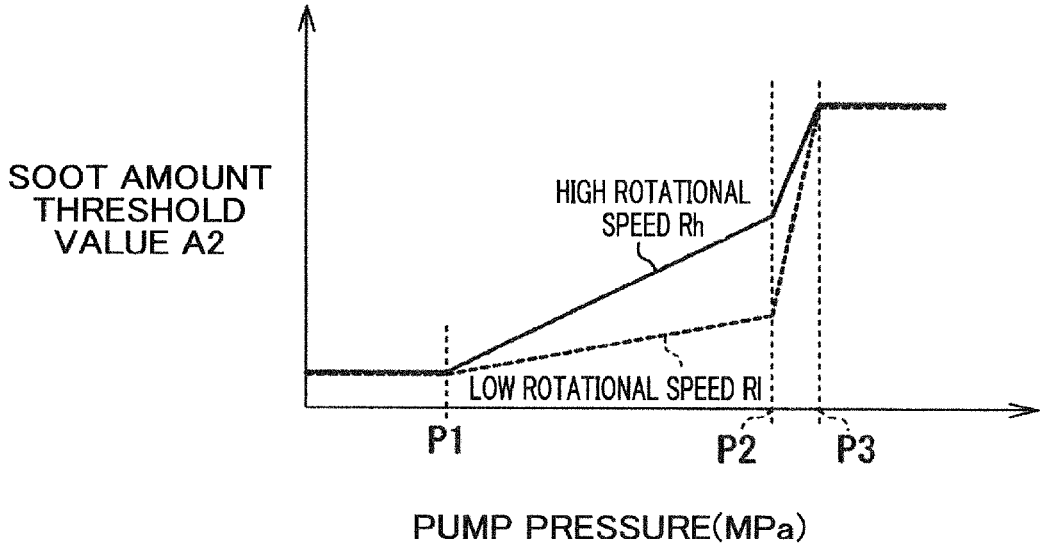
FIG. 4 is a graph showing the relationship between the soot amount threshold value A2 set in the controller and a pump pressure.

The soot amount threshold value A2 is set, for example, based on the engine rotational speed and the pump pressure detected as shown in FIG. 4. In other words, the threshold setting section of the controller 50 changes the soot amount threshold A2 according to the engine rotational speed. The threshold value setting section, for example, makes the soot amount threshold value A2 when the engine rotational speed is a higher speed Rh than a predetermined low rotational speed Rl (FIG. 4) be high as compared with the soot amount threshold A2 when the engine rotational speed is the predetermined low rotational speed Rl. The threshold setting section of the controller 50 changes the soot amount threshold A2 also according to the pump pressure. The threshold value setting section makes the soot amount threshold value A2 when the detected pump pressure is a second pump pressure P2 that is higher than a predetermined first pump pressure P1 (FIG. 4) be high as compared with the soot amount threshold A2 when the pump pressure is the first pump pressure P1. The threshold value setting section of the controller 50 may change the soot amount threshold value A2 according to only the engine rotational speed. For example, when the detected pump pressure is within a predetermined range (for example, within the load stable range B3 shown in FIG. 5), the threshold setting section may change the soot amount threshold A2 according to only the engine rotational speed and regardless of the detected pump pressure. Alternatively, the threshold value setting section may change the soot amount threshold value A2 according to only the pump pressure.

In this embodiment, the engine rotational speed is set to two levels, namely, a low speed Rl and a high speed Rh, to be selected between the low speed Rl and the high speed Rh. FIG. 4 shows specific examples of the relationship between the pump pressure and the soot amount threshold value A2 when the engine rotational speed is the low speed Rl and the high speed Rh, respectively. In the example shown in FIG. 4, the soot amount threshold value A2 is set as follows. In the low load range where the detected pump pressure is less than the first pump pressure P1, the soot amount threshold value A2 is set to a constant value regardless of the engine rotational speed. In the range where the detected pump pressure is equal to or higher than the first pump pressure P1 and equal to or lower than the third pump pressure P3 which is higher than the first and second pump pressures P1 and P2, the soot amount threshold value A2 is set such that the soot amount threshold value A2 is larger at the high rotational speed Rh than the soot amount threshold value A2 at the low rotational speed Rl. In the range where the detected pump pressure is equal to or higher than the first pump pressure P1 and equal to or lower than the third pump pressure P3, a larger soot amount threshold value A2 is set with increase in the pump pressure. More specifically, in the first intermediate range where the detected pump pressure is equal to or higher than the first pump pressure P1 and equal to or lower than the second pump pressure P2, the soot amount threshold value A2 is set so as to be proportional to the detected pump pressure (it is not necessarily limited to a proportional relationship.). In the second intermediate range where the detected pump pressure is equal to or higher than the second pump pressure P2 and equal to or lower than the third pump pressure P3, the soot amount threshold value A2 is set so as to be proportional to the detected pump pressure (not necessarily limited to the proportional relationship) and so as to make the change rate (gradient) of the soot amount threshold value A2 to the detected pump pressure be larger than that in the first intermediate range. In the high load range where the detected pump pressure is higher than the third pump pressure P3, a constant soot amount threshold value A2 is set regardless of the detected pump pressure and the engine rotational speed. In the high load range, the soot amount threshold value A2 is set to be enough large to substantially prevent the abnormality judgment section of the controller 50 from judging that the amount of soot is abnormal. This setting substantially hinders the abnormality judgment section of the controller 50 from making the abnormality judgment (step S61) in the high load range. The third pump pressure P3, which is the lower limit of the high load range, may be either equal to the upper limit B3*a* of the load stable range B3 shown in FIG. 5 or different from the upper limit B3*a*.

Although being set to the two levels (high speed Rh and low speed Rl) in the example shown in FIG. 4, the engine rotational speed may be set to three or more levels. Also in the latter case, different soot amount threshold values A2 may be set for the engine rotational speeds of three or more stages, respectively. Besides, the soot amount threshold value A2 at any level of the engine rotational speeds at a plurality of levels may be set by a complementary (for example, linear complement) calculation based on the soot amount threshold value A2 at another level. Furthermore, the soot amount threshold value A2 used in the abnormality judgment in step S21 executed under the first engine load stabilizing condition as a necessary condition may be also changed according to at least one of the detected engine rotational speed and the pump pressure. The soot amount threshold value A2 may, alternatively, be set to a constant value at all times.

In step S61, the abnormality judgment section of the controller 50 performs the same abnormality judgment as the abnormality judgment in step S21. Specifically, when the soot amount detection value which is the value of the amount of soot detected by the exhaust gas sensor 14 is larger than the soot amount threshold A2 (YES in step S61), the abnormality judgment section of the controller 50 judges that the amount of soot of the exhaust gas 11*g* is abnormal, and outputs an abnormality judgment signal (error signal) (step S63). When the soot amount detection value is less than the soot amount threshold value A2 (NO in step S61), the abnormality judgment section of the controller 50 judges that the amount of soot is not abnormal (for example, normal).

FIG. 5 is a timing chart showing an example of respective temporal changes in the physical quantity and the judgment command signal related to the second engine load stabilizing condition, wherein the lowermost solid line L1 shows an example of a normal amount of soot, and the broken line L2 shows an example of an abnormal amount of soot. From the time point t31 when the travel operation is applied to the travel operation unit 43*a* (the time point when increasing the travel operation amount is started) t31, the travel motor 23*a* is driven to increase the pump pressure and also the amount of soot. At the time point t32 when the pump pressure comes within the load stable range B3 (YES in step S35), the work machine M runs into the stable travelling state α. The travelling time count is increased from this time point t32 (step S41); however, when the detected pump pressure goes out of the load stable range B3 beyond the upper limit B3*a* thereof (NO in step S35), the travelling time count is reset at the time point t33 (step S45). Thereafter, when the pump pressure falls below the upper limit B3*a* to come within the load stable range B3 again (YES in step S35), the work machine M returns to the stable travelling state α and increasing the travelling time count is restarted (step S41). At the time point when the travelling time count reaches the count threshold value C2, that is, at the time point t41 when the stable travelling time, which is the duration of the stable travelling state α, reaches the second judgment suspension time T2, the abnormality judgment in step 61 is started. Thereafter, when the application of the travelling operation to the travelling operation unit 43*a* is released to make the travelling operation amount be 0 (that is, returns to the neutral state), the pump pressure is decreased and the amount of soot is also decreased. Then, at the time point t42 when the pump pressure becomes less than the lower limit B3*b* of the load stable range B3 to go out of the load stable range B3 (NO in step S35), the abnormality judgment in step S61 is stopped.

In this embodiment, it is preferable that the abnormality judgment section of the controller 50 determines whether or not to make the abnormality judgment in steps S21 and S61 based on the engine detection signal 15*s* input from the engine controller 15 to the controller 50. The reason is as follows.

In some state of the engine 11, it may be difficult to appropriately make the abnormality judgment. It is, therefore, preferable that the abnormality judgment section of the controller 50 judges whether or not the state of the engine 11 is a state allowing the abnormality detection to be appropriately performed, based on the engine detection signal 15*s*, and determines, according to the judgment result, whether or not to make the abnormality judgment. The engine detection signal 15*s* includes information about a detected value of a specific parameter that affects the increase/decrease in the amount of soot among the parameters that specify the operating state of the engine 11. The engine detection signal 15*s* is input from the engine controller 15 to the controller 50, for example, through CAN (Controller Area Network) communication or the like.

The specific parameter is, for example, the opening degree of an EGR (Exhaust Gas Recirculation) valve. With increase in the opening degree of the EGR valve, the concentration of the exhaust gas 11*g* and the amount of soot are increased. The specific parameter may be, alternatively, either an intake air amount, which is a flow rate of air taken into the engine 11, or a flow rate of air taken into a main body of the engine 11 from a supercharger (for example, a variable capacity supercharger), or the boost pressure of a supercharger. The smaller the intake air amount, the richer the fuel in the combustion chamber of the engine 11 and the larger the amount of soot. The specific parameter may be alternatively a fuel injection amount into the combustion chamber. The larger the fuel injection amount, the richer the fuel in the combustion chamber and the larger the amount of soot.

In the mode including the setting of the threshold value based on the detection value of the specific parameter, the abnormality judgment section of the controller 50 judges whether or not the detection value of the specific parameter included in the engine detection signal 15*s* is within a predetermined judgment permissible range. The judgment permissible range is set to a range of a detection value that allows the abnormality judgment section of the controller 50 to appropriately make the abnormality judgment. If the abnormality judgment was made when the value of the specific parameter has gone out of the judgment permissible range in the direction of increasing the amount of soot increases, the amount of soot could exceed the soot amount threshold value A2 shown in FIG. 3 to cause the abnormality judgment section of the controller 50 to erroneously judge that the abnormality is "abnormal" in spite that the actual amount of soot is not abnormal. Inversely, if the value of the specific parameter is out of the judgment permissible range in the direction of decreasing the amount of soot, there is a possibility of failing to secure the amount of soot necessary for making the abnormality judgment. If executing the abnormality judgment in such a state, the abnormality judgment section might fail to make a judgment of "abnormal", even though the engine 11 is actually out of order, because the soot amount detection value does not exceed the soot amount threshold value A2. In contrast, the abnormality judgment section, which suspends the abnormality judgment when the detected value of the specific parameter is out of the judgment permissible range, can avoid the erroneous judgment. Besides, If having already performed the abnormality judgment (steps S21 and S61), the controller 50 cancels the abnormality judgment. In other words, it is preferable that the abnormality judgment section is configured to make the abnormality judgment on the necessary condition that the detected value of the specific parameter is within the judgment permissible range. Similarly to the soot amount threshold value A2 shown in FIG. 4, the judgment permissible range may be either changed by the controller 50 according to the operating state of the engine 11 or set to a constant range at all times. Besides, there may be set only one of the upper limit and the lower limit of the judgment permissible range.

When the engine 11 fails, a large amount of soot is generated to make the amount of soot be abnormal as compared with the case where the engine 11 does not fail. Specific examples of the cause of the abnormal amount of soot include the following [Example 1] to [Example 5]. [Example 1] The amount of soot may be increased by internal damage in the main body of the engine 11 (such as the combustion chamber). For example, the amount of soot may be increased by damage to the piston or the like. [Example 2] The amount of soot may be increased by enrichment of fuel in the combustion chamber due to wear of the injector, failure of the engine controller 15, or the like, it. [Example 3] The amount of soot may be increased by enrichment of fuel in the combustion chamber due to an abnormality in the supercharging pressure caused by a failure of the supercharger of the engine 11. The abnormality in the supercharging pressure may be caused also by a failure of a sensor provided in the supercharger. [Example 4] The amount of soot may be increased by enrichment of fuel in the combustion chamber due to the clogging in the air cleaner through which the air taken into the engine 11 passes. [Example 5] In the case of including an intercooler for cooling the intake air of the engine 11, the amount of soot may be increased by enrichment of fuel in the combustion chamber due to disconnection of a hose for supplying the cooling liquid to the intercooler from the intercooler.

The exhaust gas sensor 14 provided upstream of the exhaust gas aftertreatment device 13 enables the above appropriate abnormality judgment to be made. In contrast, the absence of the exhaust gas sensor 14 may cause the following problem. The collection of soot by the exhaust gas aftertreatment device 13 almost prevents the soot from being discharged to the atmosphere, which hinders an operator from finding out the abnormality of the amount of soot by visual check of the gas discharged from the work machine M even if the engine 11 breaks down to increase the amount of soot. Besides, in the case where a sensor for detecting the amount of soot is provided downstream of the exhaust gas aftertreatment device 13 (hereinafter, such a sensor is referred to as "downstream side sensor") in order to detect a failure of the exhaust gas aftertreatment device 13, it is still impossible to visually find out an abnormality in the amount of soot upstream of the exhaust gas aftertreatment device 13 that collects soot, that is, a sign of a failure of the engine 11. The downstream sensor may be able to detect an abnormal state of the amount of soot if the failure of the engine 11 progresses to remarkably increase the amount of soot; however, at the time when the amount of soot is detected, the failure of the engine 11 has already progressed, and there is a further possibility that the exhaust gas aftertreatment device 13 may also be out of order. Leaving such a failure of the engine 11 or the exhaust gas aftertreatment device 13 without recognizing it until this stage may significantly increase the cost and time for repairing or replacing the engine 11 or the exhaust gas aftertreatment device 13. In contrast, the work machine M according to the embodiment including the exhaust gas sensor 14 enables the abnormality of the amount of soot of the exhaust gas on the upstream side of the exhaust gas aftertreatment device 13 to be appropriately judged, which allows the failure of the engine 11 to be found out early. Thus, according to the work machine M, all or at least some of the above problems are effectively solved or suppressed.

The above embodiment may be variously modified. For example, the connection of each component shown in FIG. 1 may be changed. For example, the order of steps in the flowchart shown in FIG. 2 may be changed. For example, the number of components of the work machine M may be changed, and components other than the components of the present invention may be omitted. For example, some of the steps shown in FIG. 2 may be omitted.

As described above, there is provided a work machine provided with an engine, the work machine including an exhaust gas aftertreatment device and an exhaust pipe disposed upstream thereof, the work machine being capable of detecting an abnormality in the amount of soot in the exhaust pipe.

Provided is a work machine, which includes an engine, an exhaust pipe, an exhaust gas aftertreatment device, an exhaust gas sensor, and a controller. The engine is a power source of the work machine. The exhaust pipe is connected to the engine so as to allow exhaust gas of the engine to pass through the exhaust pipe. The exhaust gas aftertreatment device collects soot contained in the exhaust gas discharged from the engine through the exhaust pipe.

As the feature of the work machine, the exhaust gas sensor is attached to the exhaust pipe so as to detect an amount of soot of exhaust gas in the exhaust pipe at a position between the engine and the exhaust gas aftertreatment device, and generates a soot amount detection signal corresponding to the amount of soot. The controller is connected to the exhaust gas sensor so as to allow the detection signal to be input from the exhaust gas sensor to the controller. The controller includes an abnormality judgment section that makes an abnormality judgment that is a judgment on whether or not the amount of soot in the exhaust gas corresponding to the soot amount detection signal is abnormal, and a threshold setting section that sets a soot amount threshold value that is a threshold value for making the abnormality judgment. The abnormality judgment section is configured to judge that the amount of soot of the exhaust gas is abnormal to output an abnormality judgment signal when the soot amount detection value that is the value of the amount of soot corresponding to the soot amount detection signal of the exhaust gas sensor is larger than the soot amount threshold value.

According to the work machine, regardless of the soot collection by the exhaust gas aftertreatment device, it is appropriately judged whether or not the amount of soot of exhaust gas flowing in the exhaust pipe upstream of the exhaust gas aftertreatment device is abnormal. More specifically, even if the amount of soot in the exhaust gas flowing in the exhaust pipe on the upstream side of the exhaust gas aftertreatment device is a amount of soot that can be properly collected by the exhaust gas aftertreatment device, it can be detected that the amount of soot upstream of the upstream side is abnormal. This makes it possible to detect the engine failure early and to suppress the progress of the failure.

In the work machine, the abnormality judgment section is preferably configured to make the abnormality judgment on a necessary condition that at least one engine load stabilization condition that is a preset condition for stabilizing the load on the engine is satisfied and to suspend the abnormality judgment when the engine load stabilization condition is not satisfied.

The suspension of the abnormality judgment when the engine load stabilizing condition is not satisfied is effective in preventing erroneous judgment. Specifically, suspending the abnormality judgment in a case where the load of the engine is unstable, which renders the amount of soot unstable and may hinder the abnormality judgment from being appropriately performed, makes it possible to avoid erroneous judgment. In other words, when the abnormality judgment section makes the abnormality judgment, the at least one engine load stabilization condition is satisfied, so that proper abnormality judgment is guaranteed.

The at least one engine load stabilizing condition may include a plurality of engine load stabilizing conditions. In this case, the abnormality judgment section is configured to make the abnormality judgment on the necessary condition that at least one of the plurality of engine load stabilizing conditions is satisfied and to suspend the abnormality judgment when none of the plurality of engine load stabilizing conditions is satisfied.

In the case of the work machine including: a hydraulic pump that is driven by power generated by the engine to discharge hydraulic oil; at least one hydraulic actuator that is operated by supply of hydraulic oil from the hydraulic pump to actuate a specific portion of the work machine; a load applying section that performs a load applying operation of applying a load to the hydraulic pump; and at least one operation unit to which an operation for operating the at least one hydraulic actuator is applied, it is preferable that the controller further includes a load application control section that performs a load application control that is a control of the load application operation of the load application section and the at least one engine load stabilization condition includes a condition that no operation for operating the hydraulic actuator is applied to any of the at least one of the operation unit and the load application control is being performed.

The conditions relating to the presence/absence of the operation and the presence/absence of the load application control makes it possible to prevent erroneous judgment from being performed due to the execution of the abnormality judgment in the state of unstable engine load. Specifically, in the state where the hydraulic actuator is operating, the load of the engine is difficult to stabilize and the amount of soot is likely to be unstable; therefore, executing the abnormality judgment in such a state generates a possibility of erroneous judgment that the amount of soot exceeds the soot amount threshold value to be abnormal in spite that the actual amount of soot is not abnormal. In contrast, suspending the abnormality judgment when the condition that the operation is absent and the load application control is being performed is not satisfied makes it possible to suppress the erroneous judgment. Besides, performing no load application control in a state of no operation applied to any of the at least one operation unit generates a possibility of failing to secure the amount of soot required to appropriately make the abnormality judgment because the load applied to the engine is small, and executing the abnormality judgment in such a state generates a possibility of failing to judge the state as being abnormal, in spite that the engine has failed, because the soot amount detection value does not exceed the soot amount threshold. In contrast, treating the absence of the above-mentioned operation and execution of load application control as the necessary condition enables the abnormality judgment to be performed only when the amount of soot is stable and enables erroneous judgement from being avoided.

It is preferable that the load application control section and the abnormality judgment section are preferably configured to stop the load application control and the abnormality judgment, respectively, when an operation for operating the at least one hydraulic actuator is applied to the at least one operation unit while the load application control and the abnormality judgment are performed, and that the controller is configured to operate the hydraulic actuator corresponding to the operation that is applied to the at least one operation unit.

The stop of the abnormality judgment makes it possible to suppress erroneous judgment due to performance of the abnormality judgment in a state where the operation for operating the at least one hydraulic actuator is applied to the at least one operation unit. Besides, the suspension of the load application control can also restrain the hydraulic actuator from making a motion contrary to the intention of the operator.

In the case of the work machine further including a hydraulic pump driven by power generated by the engine to discharge hydraulic oil, a travelling motor that is driven by supply of hydraulic oil from the hydraulic pump to cause the work machine to travel, and a travel operation unit to which a travel operation that is an operation for operating the travel motor is applied, it is preferable that the at least one engine load stabilization condition includes a condition that the travel operation amount that is a magnitude of the travel operation is larger than a preset travel operation amount threshold value and the pump pressure that is a discharge pressure of the hydraulic pump is within a preset load stable range.

The conditions with respect to the travelling operation and the pump pressure enable the abnormality judgment to be made during travelling of the work machine with sufficient and stable amount of soot, by allowing the abnormality judgment to be made when the work machine is travelling with the load of the engine being stable. Conversely, it is possible to suppress erroneous judgment due to execution of the abnormality judgment when the work machine is stopped to render the engine load small, or when the engine load is unstable due to the state of the ground on which the travelling is performed.

The threshold value setting section may be configured to change the soot amount threshold value according to the engine rotational speed. This makes it possible to perform an appropriate abnormality judgment regardless of changes in the amount of soot involved by change in the engine rotational speed. For example, it is possible to restrain an erroneous judgment that the amount of soot is abnormal from being made despite that the actual amount of soot is not abnormal, which is caused by low soot amount threshold in spite of high engine rotational speed, and/or to restrain an erroneous judgment that the amount of soot is not abnormal from being made despite that the engine is actually failed, which is caused by high soot amount threshold in spite of low engine rotational speed.

The threshold value setting section is preferably configured to change the soot amount threshold value according to the pump pressure. This enables an appropriate abnormality judgment to be made regardless of the change in the amount of soot involved by the change in the pump pressure, similarly to changing the threshold value according to the change in the engine rotational speed.

It is preferable that an engine detection signal including information about a detection value of a specific parameter that is a parameter specifying an operating state of the engine and affecting increase and decrease in the amount of soot of exhaust gas is input to the controller and that the abnormality judgment section is configured to suspend the abnormality judgment when the detection value of the specific parameter is out of a preset judgment permissible range. This makes it possible to suppress an erroneous judgment due to making the abnormality judgment when the engine operation condition hinders an amount of soot suitable for proper abnormality judgment from being secured.

The invention claimed is:

1. A work machine, comprising:

an engine that is a power source of the work machine;

an exhaust pipe connected to the engine so as to allow exhaust gas of the engine to pass through the exhaust pipe;

an exhaust gas aftertreatment device that collects soot contained in the exhaust gas discharged from the engine through the exhaust pipe;

an exhaust gas sensor attached to the exhaust pipe so as to detect an amount of soot in the exhaust gas in the exhaust pipe at a position between the engine and the exhaust gas aftertreatment device and configured to generate a soot amount detection signal corresponding to the amount of soot; and a controller connected to the exhaust gas sensor so as to allow the soot amount detection signal of the exhaust gas sensor to be input to the controller, wherein:

the controller includes an abnormality judgment section that makes an abnormality judgment that is a judgment whether or not the amount of soot corresponding to the soot amount detection signal is abnormal, and a threshold value setting section that sets a soot amount threshold value that is a threshold value for making the abnormality judgment;

the abnormality judgment section is configured to judge that the amount of soot of the exhaust gas is abnormal to output an abnormality judgment signal when the soot amount detection value that is a value of the amount of soot corresponding to the soot amount detection signal is larger than the soot amount threshold value; and the abnormality judgment section is configured to make the abnormality judgment on a necessary condition that at least one engine load stabilization condition that is a preset condition for stabilizing a load on the engine is satisfied and to suspend the abnormality judgment when the engine load stabilization condition is not satisfied.

2. The work machine according to claim 1, wherein the at least one engine load stabilizing condition includes a plurality of engine load stabilizing conditions, and the abnormality judgment section is configured to make the abnormality judgment on the necessary condition that at least one of the plurality of engine load stabilizing conditions is satisfied and to suspend the abnormality judgment when none of the plurality of engine load stabilizing conditions is satisfied.

3. The work machine according to claim 1, further comprising: a hydraulic pump that is driven by power generated by the engine to discharge hydraulic oil; at least one hydraulic actuator that is operated by supply of hydraulic oil from the hydraulic pump to actuate a specific portion of the work machine; a load applying section that performs a load applying operation of applying a load to the hydraulic pump; and at least one operation unit to which an operation for operating the at least one hydraulic actuator is applied, wherein the controller further includes a load application control section that performs a load application control that is a control of the load application operation of the load application section, and the at least one engine load stabilization condition includes a condition that no operation for operating the hydraulic actuator is applied to any of the at least one of the operation unit and the load application control is being performed.

4. The work machine according to claim 3, wherein: the load application control section and the abnormality judgment section are configured to stop the load application control and the abnormality judgment, respectively, when an operation for operating the at least one hydraulic actuator is applied to the at least one operation unit while the load application control and the abnormality judgment are performed; and the controller is configured to operate the hydraulic actuator corresponding to the operation that is applied to the at least one operation unit according to the operation.

5. The work machine according to claim 1, further comprising: a hydraulic pump that is driven by power generated by the engine to discharge hydraulic oil, a travelling motor that is driven by supply of hydraulic oil from the hydraulic pump to cause the work machine to travel, and a travel operation unit to which a travel operation that is an operation for operating the travel motor is applied, wherein the at least one engine load stabilization condition includes a condition that the travel operation amount that is a magnitude of the travel operation is larger than a preset travel operation amount threshold value and a pump pressure that is a discharge pressure of the hydraulic pump is within a preset load stable range.

6. The work machine according to claim 1, wherein: an engine detection signal including information about a detection value of a specific parameter that is a parameter specifying an operating state of the engine and affecting increase and decrease in the amount of soot of exhaust gas is input to the controller; and the abnormality judgment section is configured to suspend the abnormality judgment when the detection value of the specific parameter is out of a preset judgment permissible range.

7. A work machine, comprising:

an engine that is a power source of the work machine;

an exhaust pipe connected to the engine so as to allow exhaust gas of the engine to pass through the exhaust pipe;

an exhaust gas aftertreatment device that collects soot contained in the exhaust gas discharged from the engine through the exhaust pipe;

an exhaust gas sensor attached to the exhaust pipe so as to detect an amount of soot in the exhaust gas in the exhaust pipe at a position between the engine and the exhaust gas aftertreatment device and configured to generate a soot amount detection signal corresponding to the amount of soot; and a controller connected to the exhaust gas sensor so as to allow the soot amount detection signal of the exhaust gas sensor to be input to the controller, wherein:

the controller includes an abnormality judgment section that makes an abnormality judgment that is a judgment whether or not the amount of soot corresponding to the soot amount detection signal is abnormal, and a threshold value setting section that sets a soot amount threshold value that is a threshold value for making the abnormality judgment;

the abnormality judgment section is configured to judge that the amount of soot of the exhaust gas is abnormal to output an abnormality judgment signal when the soot amount detection value that is a value of the amount of soot corresponding to the soot amount detection signal is larger than the soot amount threshold value; and wherein the threshold value setting section is configured to change the soot amount threshold value according to a rotational speed of the engine.

8. A work machine, comprising:

an engine that is a power source of the work machine;

an exhaust pipe connected to the engine so as to allow exhaust gas of the engine to pass through the exhaust pipe;

an exhaust gas aftertreatment device that collects soot contained in the exhaust gas discharged from the engine through the exhaust pipe;

an exhaust gas sensor attached to the exhaust pipe so as to detect an amount of soot in the exhaust gas in the exhaust pipe at a position between the engine and the exhaust gas aftertreatment device and configured to generate a soot amount detection signal corresponding to the amount of soot; and a controller connected to the exhaust gas sensor so as to allow the soot amount detection signal of the exhaust gas sensor to be input to the controller, wherein:

the controller includes an abnormality judgment section that makes an abnormality judgment that is a judgment whether or not the amount of soot corresponding to the soot amount detection signal is abnormal, and a threshold value setting section that sets a soot amount threshold value that is a threshold value for making the abnormality judgment;

the abnormality judgment section is configured to judge that the amount of soot of the exhaust gas is abnormal to output an abnormality judgment signal when the soot amount detection value that is a value of the amount of soot corresponding to the soot amount detection signal is larger than the soot amount threshold value; and wherein the threshold value setting section is configured to change the soot amount threshold value according to a pump pressure that is a discharge pressure of a hydraulic pump.

* * * * *